US009464570B2

(12) United States Patent
Heimanns

(10) Patent No.: US 9,464,570 B2
(45) Date of Patent: Oct. 11, 2016

(54) CRANK DRIVE

(76) Inventor: Konrad Heimanns, Neuss (DE)

( * ) Notice: Subject to any disclaimer, the term of this patent is extended or adjusted under 35 U.S.C. 154(b) by 1042 days.

(21) Appl. No.: 13/384,367

(22) PCT Filed: Feb. 26, 2010

(86) PCT No.: PCT/EP2010/052479
§ 371 (c)(1),
(2), (4) Date: Apr. 2, 2012

(87) PCT Pub. No.: WO2011/006683
PCT Pub. Date: Jan. 20, 2011

(65) Prior Publication Data

US 2012/0180752 A1 Jul. 19, 2012

(30) Foreign Application Priority Data

Jul. 14, 2009 (DE) ..... 10 2009 033 249

(51) Int. Cl.
*F02B 75/32* (2006.01)
*F02B 41/04* (2006.01)

(52) U.S. Cl.
CPC ..... *F02B 75/32* (2013.01); *F02B 41/04* (2013.01)

(58) Field of Classification Search
CPC ..... F02B 75/32; F02B 41/04; F02B 41/00
USPC ..... 123/197.1, 197.4
See application file for complete search history.

(56) References Cited

U.S. PATENT DOCUMENTS 3,206,333 A 9/1965 Ehrenfeld
3,633,429 A * 1/1972 Olson ..... F02B 41/04 123/197.3
4,538,557 A * 9/1985 Kleiner et al. ..... 123/197.4
5,025,759 A 6/1991 Wenzel et al.
5,309,779 A 5/1994 Sarno
5,398,652 A * 3/1995 Jackson ..... F16J 9/20 123/197.3
7,409,901 B2 8/2008 Lucas et al.
2007/0056552 A1 3/2007 Fisher
2007/0101712 A1 5/2007 Negre et al.
2007/0137596 A1 * 6/2007 Brickley ..... 123/197.1
2010/0180868 A1 7/2010 Scalzo

FOREIGN PATENT DOCUMENTS

CN 1094478 A 11/1994
CN 1285460 A 2/2001
CN 1690384 A 11/2005

(Continued)

*Primary Examiner* — Lindsay Low
*Assistant Examiner* — Kevin Lathers
(74) *Attorney, Agent, or Firm* — Laurence A. Greenberg; Werner H. Stemer; Ralph E. Locher

(57) ABSTRACT

A crank drive has a frame, which may be formed in particular by a housing, a rocker fixed on the frame, a crank that is fixed on the frame and which forms the drive output, and a coupler which connects the rocker and the crank. The coupler is articulately connected in each case to the crank and to an end, which is situated opposite the positionally fixed mounting, of the rocker. In order to drive the crank, a first cylinder is provided which has a movably mounted piston. The piston and the rocker are articulately connected to one another via a push rod such that the axial movement of the piston sets the rocker in an oscillating swinging motion. The rocker has a section that is remote from the fixed mounting of the rocker and which is inclined by a fixed angle towards the coupler.

15 Claims, 4 Drawing Sheets

(56) References Cited

FOREIGN PATENT DOCUMENTS

| | | | |
|---|---|---|---|
| CN | 1926307 | A | 3/2007 |
| DE | 245708 | C | 10/1909 |
| DE | 1698561 | U | 5/1955 |
| DE | 1074724 | B | 2/1960 |
| DE | 1421597 | A1 | 4/1969 |
| DE | 3521626 | A1 | 12/1986 |
| DE | 68923974 | T2 | 5/1996 |
| DE | 10 2005 061 282 | A1 | 6/2007 |
| FR | 977 781 | | 4/1951 |
| FR | 2 496 760 | A1 | 6/1982 |
| RU | 2344300 | C2 | 1/2009 |
| RU | 2351784 | C2 | 4/2009 |
| WO | 2009/006682 | A1 | 1/2009 |

* cited by examiner

CRANK DRIVE

BACKGROUND OF THE INVENTION

Field of the Invention

The present application relates to a crank drive. It comprises a frame, which may be formed in particular by a housing, and a rocker mounted in a fixed position on the frame. The crank drive furthermore has a crank, which is mounted in a fixed position on the frame and which forms the drive output. A coupler connects the rocker and the crank. For this purpose, the coupler is connected in an articulated manner in each case to the crank and to an opposite end of the rocker from the positionally fixed mounting.

Crank drives of this kind are used to convert a linear oscillating motion into a circular motion. DE 1 698 561 U, for example, shows a double crank drive with no dead center position having two rockers, which are each connected to a crankshaft by a coupler in the manner of a toggle joint. The persons actuating the double crank drive exert pressure and tension on the rockers by means of their hands or feet. The resulting oscillating swinging motion of the rockers is converted into a rotary motion of the crankshaft by a respective coupler connecting the rocker to the crankshaft.

The disadvantage of this crank drive is, in particular, the design of the rockers as long levers, these being required to transmit the force exerted to the drive output shaft. As a result of the long levers, the crank drive shown requires a large amount of space, and the levers prevent a compact design.

BRIEF SUMMARY OF THE INVENTION

It is the object of the present application to propose a crank drive of simple construction which, through its compact design, opens up new possibilities for use.

According to the invention, this object is achieved by the crank drive according to claim. Advantageous embodiments and developments of the invention will emerge from the dependent claims.

The essential aspect of the solution according to the invention is that, to drive the crank, a first cylinder is provided which has a movably mounted piston, and that the piston and the rocker are connected to one another in an articulated manner by way of a connecting rod, with the result that the axial motion of the piston sets the rocker in an oscillating swinging motion.

One principal advantage of the solution according to the invention is that large forces can be built up in a cylinder operated by means of a pressure medium, despite a compact design. In particular, the pressure cylinder can be of flat construction, with the result that the crank drive according to the invention takes up a particularly small overall height.

The pressure cylinder enables the rocker to be designed as a short lever arm. By virtue of the force that can be exerted on the rocker by the piston of the cylinder, a small lever is sufficient to produce a large torque at the crank. Moreover, the toggle-joint-type mechanism consisting of the rocker and the coupler intensifies the torque applied to the crank. With the increasingly straightened alignment of the rocker and the coupler, a steeply rising torque is transmitted to the crank.

In this way, which is particularly simple in terms of design, the available torque produced at the crank is high, despite the compact dimensions of the crank drive. Another advantage of the crank drive according to the invention is the ease with which the pressure cylinder can be controlled. Moreover, the cylinder can be operated at different speeds between the endpoints of its linearly oscillating axial motion and can thus be adjusted in an optimum manner to the various angular positions of the toggle-joint-type mechanism and the resulting rotation of the crank.

Accordingly, the crank drive according to the invention forms a motor, which offers a wide range of possible applications with its compact and, in particular, its especially flat design.

The rocker comprises a section which is remote from the positionally fixed mounting of the rocker and which is bent at a fixed angle toward the coupler. By virtue of this bend, the longitudinal axis of the rocker and the longitudinal axis of the section thereof which is remote from the positionally fixed mounting of the rocker are aligned obliquely relative to one another. The rocker and the section thereof which is inclined toward the coupler are preferably of integral design.

The inclination of the rocker toward the coupler leads to an obtuse angle at the toggle-lever-type joint between the rocker and the coupler. As a result, the joint is moved in an angular range favorable for the toggle lever effect over a large angle of rotation of the crank. The force intensification of the toggle lever thus takes effect to a greater extent during the rotation of the crank.

In particular, the crank drive according to the invention can be matched to the respective conditions of use in a simple manner by changing the length of the bent section and/or varying the angular position thereof toward the longitudinal axis of the rocker. It is thereby possible precisely to define the angle of rotation of the crank within which a particularly high torque is transmitted.

It is furthermore advantageous if the stroke axis of the first cylinder is aligned at an angle oblique to a plane perpendicular to the rocker. The more acute the angle chosen, the greater is the reduction in the axial width of the crank drive. In this way, the pressure-driven motor according to the invention can be made even more compact.

It is furthermore particularly advantageous if the connecting rod is attached in an articulated manner at the point where the rocker bends. The transverse force acting on the piston plays a significant part in the efficiency of the cylinder. The more sharply the connecting rod connecting the piston to the rocker is angled relative to the stroke axis during the axial motion of the piston, the greater is the transverse force. It is therefore particularly advantageous to align the positions of the stroke axis of the piston, of the positionally fixed mounting and of the articulated attachment to the rocker with one another in such a way that the connecting rod performs its motion with as small as possible an angular deviation relative to the stroke axis during the swinging motion of the rocker. The articulated attachment according to the invention of the connecting rod at the point where the rocker bends allows positioning of the cylinder in a way which reduces the axial width of the crank drive while at the same time achieving small transverse forces on the piston, exploiting the maximum lever action on the rocker for this arrangement of the cylinder.

It is furthermore particularly advantageous if the rocker is connected in an articulated manner to a second piston contained in a second cylinder, wherein the second cylinder is arranged on an opposite side of the rocker from the first cylinder. By means of the second cylinder, it is possible further to increase the torque acting on the crank without significantly increasing the space requirement for the crank drive. The cylinder designation selected in this application, referring to the first and second cylinder, is not linked to any special function and can be interchanged.

It is advantageous if the connecting rods are attached in an articulated manner to an extension of the rocker, said extension in each case being arranged transversely to the rocker. This counteracts a reduction in the cross section of the rocker in the region of the articulated attachment points of the connecting rods and prevents weakening of the rocker.

It is furthermore particularly advantageous if the lateral extension of the rocker is arranged on that section of the rocker which is inclined toward the coupler.

It is advantageous if the first cylinder and the second cylinder are arranged offset relative to one another along the longitudinal axis of the rocker, wherein the stroke of the piston of the cylinder situated closer to the swing pivot of the rocker is smaller than the stroke of the piston of the other cylinder.

It is furthermore particularly advantageous if the stroke axis of the first cylinder is at an angle oblique to the stroke axis of the second cylinder. This makes it possible to position each individual cylinder in such a way that the transverse force acting on the piston thereof is minimized.

It is advantageous if the dead center position of the crank is crossed at the upper point of reversal of the axial motion of the piston. This makes it possible to transmit an increased torque immediately through the incipient axial motion of the piston.

In a particularly preferred embodiment, the cylinder is part of a combustion engine. The piston and the cylinder accordingly form a combustion chamber into which an air/fuel mixture is introduced for ignition. The piston of the combustion engine is driven in the direction of the bottom dead center position thereof by the pressure produced by the combustion of the air/fuel mixture. As the volume of the combustion chamber increases, the pressure in the combustion chamber is correspondingly reduced. At the same time, the motion of the piston changes the angle of the toggle lever and hence the force transmission thereof.

During the motion of the piston from the top dead center to the bottom dead center position, the angle of the toggle lever is straightened out to a greater extent owing to the bend according to the invention in the rocker than is the case with a crank drive that has a straight rocker. The toggle lever is accordingly set at a comparatively more favorable angle for the toggle lever effect over the entire stroke of the piston. In particular, the high pressures that drive the piston immediately after the ignition of the mixture are subject to better force transmission by virtue of the more straightened toggle lever.

Further advantages and features of the invention will emerge from the following description and from the embodiment illustrated in the drawing.

DESCRIPTION OF THE INVENTION

Figure 1:
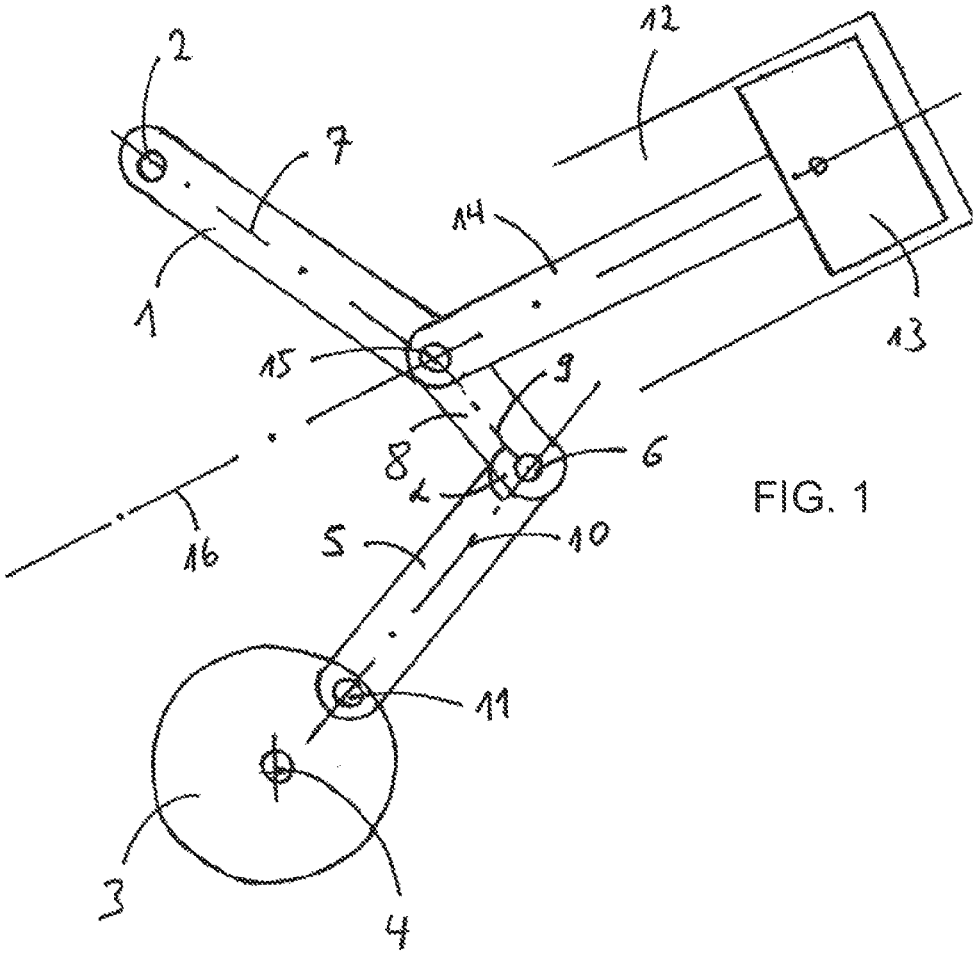
FIG. 1 shows an embodiment of the crank drive according to the invention, in which the crank is driven by means of a cylinder.

The crank drive sketched in FIG. 1 comprises a rocker 1, which is mounted in a fixed position at one end, by means of a swing pivot 2, on a frame (not shown). The drive output from the crank drive takes place via a crank 3, which is mounted on the frame, likewise in a fixed position, by means of its pivot 4. Swing pivot 2 and pivot 4 are aligned parallel to one another. A coupler 5 is connected by means of a joint 6 to a section 8 angled relative to the longitudinal axis 7 of the rocker 1.

The angled section 8 is inclined relative to the longitudinal axis 7 of the rocker 1, at a fixed angle to the coupler 5, and is preferably embodied integrally with the rocker 1. As a result, an angle a which varies with the rotary motion of the crank 3 is formed between a longitudinal axis 9 of the section 8 angled toward the coupler 5 and a longitudinal axis 10 of the coupler 5. During the rotary motion of the crank 3, the angle a is more obtuse than the angle between the extended longitudinal axis 7 of the rocker 1 and the longitudinal axis 10 of the coupler 5. In comparison with a toggle lever effect that can be produced by means of a straight rocker, i.e. a rocker without an angled section, the toggle lever effect acting at the joint 6 due to the angled section 8 is intensified.

Moreover, the angle between the longitudinal axis 7 of the rocker 1 and the longitudinal axis 10 of the coupler 5 makes it possible to shorten the distance between the positionally fixed mounting of the rocker 1 on the swing pivot 2 and the positionally fixed mounting of the crank 3 on the pivot 4. This allows an intensified toggle lever effect while retaining the compact design of the crank drive according to the invention. The size of the fixed angle is chosen in accordance with the desired force transmission in the toggle lever and/or the desired shortening of the design. In the embodiment, it is about 15 degrees.

At an opposite end of the coupler 5 from the joint 6, said coupler is connected in an articulated manner to the outer region of the crank 3. A force acting on the crank 3 via this joint 11 produces a rotary motion of the crank 3, which is transferred to a drive output shaft of the motor according to the invention.

A cylinder 12, which can be filled with pressure medium and the piston 13 of which is attached in an articulated manner, by means of a connecting rod 14, to the rocker 1, is provided as the drive input of the rocker 1. A joint 15 between the connecting rod 14 and the rocker 1 lies at the bend between the rocker 1 and the angled section 8 thereof. When the piston 13 is fully retracted, the stroke axis 16 of the cylinder 12 is aligned obliquely to a plane perpendicular to the rocker 1.

Figure 2:
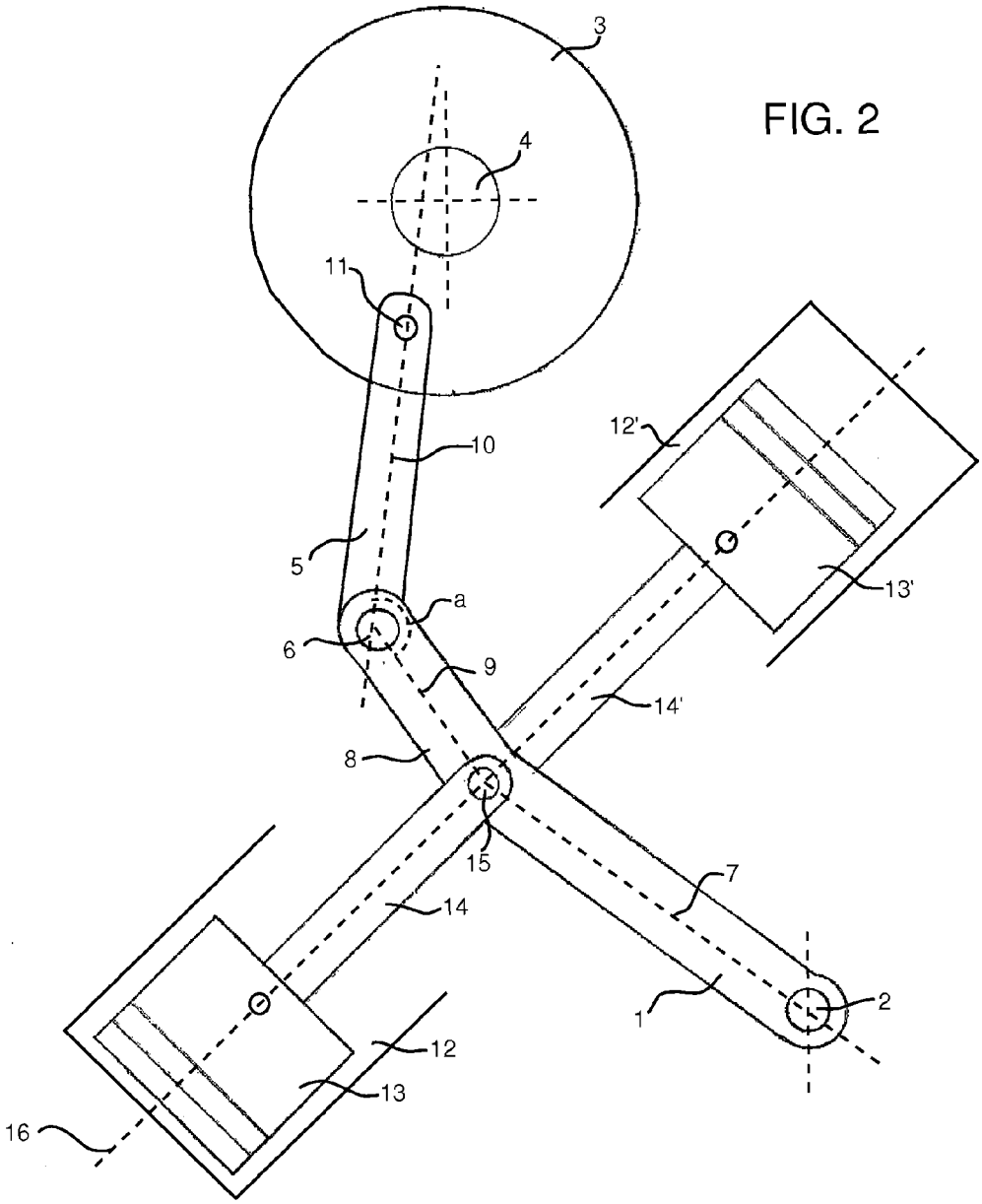
FIG. 2 shows an embodiment of the crank drive according to the invention, in which the crank is driven by means of two cylinders.

The crank drive sketched in FIG. 2 adds a second cylinder 12' arranged on an opposite side of the rocker 1 from the first cylinder 12, which can be filled with pressure medium and the piston 13' of which is attached in an articulated manner, by means of a connecting rod 14', to the rocker 1, is provided as a drive input of the rocker 1. A joint 15 between the connecting rods 14, 14' and the rocker 1 lies at the bend between the rocker 1 and the angled section 8 thereof. When the piston 13 is fully retracted, the stroke axis 16 of the cylinder 12 is aligned obliquely to a plane perpendicular to the rocker 1.

Figure 3:
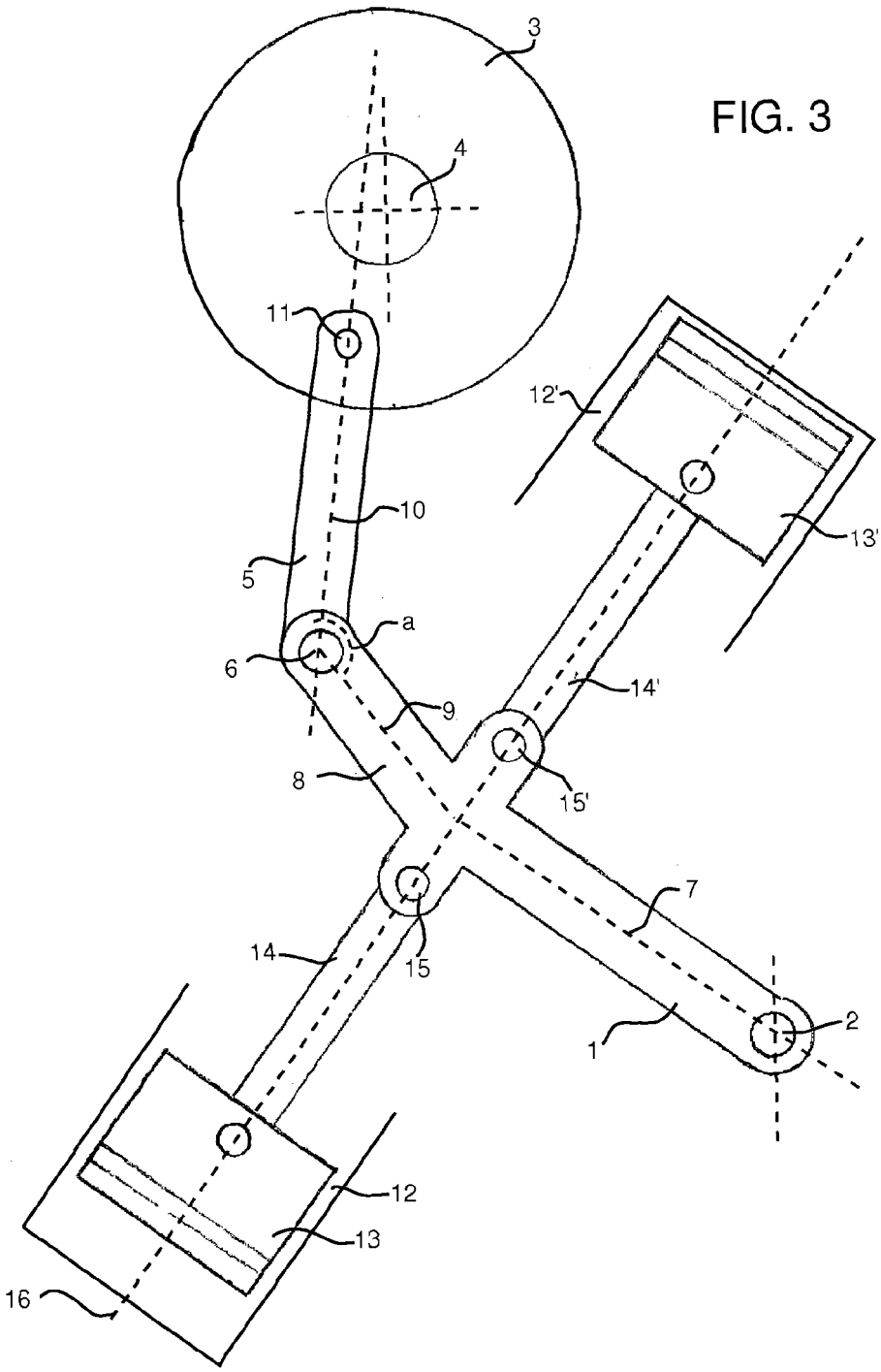
FIG. 3 shows an embodiment of the crank drive according to the invention, in which the crank is driven by means of two cylinders.

The crank drive sketched in FIG. 3 has cylinders 12 and 12', which can be filled with pressure medium and the pistons 13 and 13' respectively of which are attached in an articulated manner, by means of connecting rods 14 and 14', to extensions of the rocker 1. They provide the drive inputs of the rocker 1. Joints 15 and 15' connecting the connecting rods 14 and 14' respectively to the rocker 1 lie on extensions of the rocker 1 on the stroke axis 16 transversely to the bend between the rocker 1 and the angled section 8 thereof. When the piston 13 is fully retracted, the stroke axis 16 of the cylinder 12 is aligned obliquely to a plane perpendicular to the rocker 1.

Figure 4:
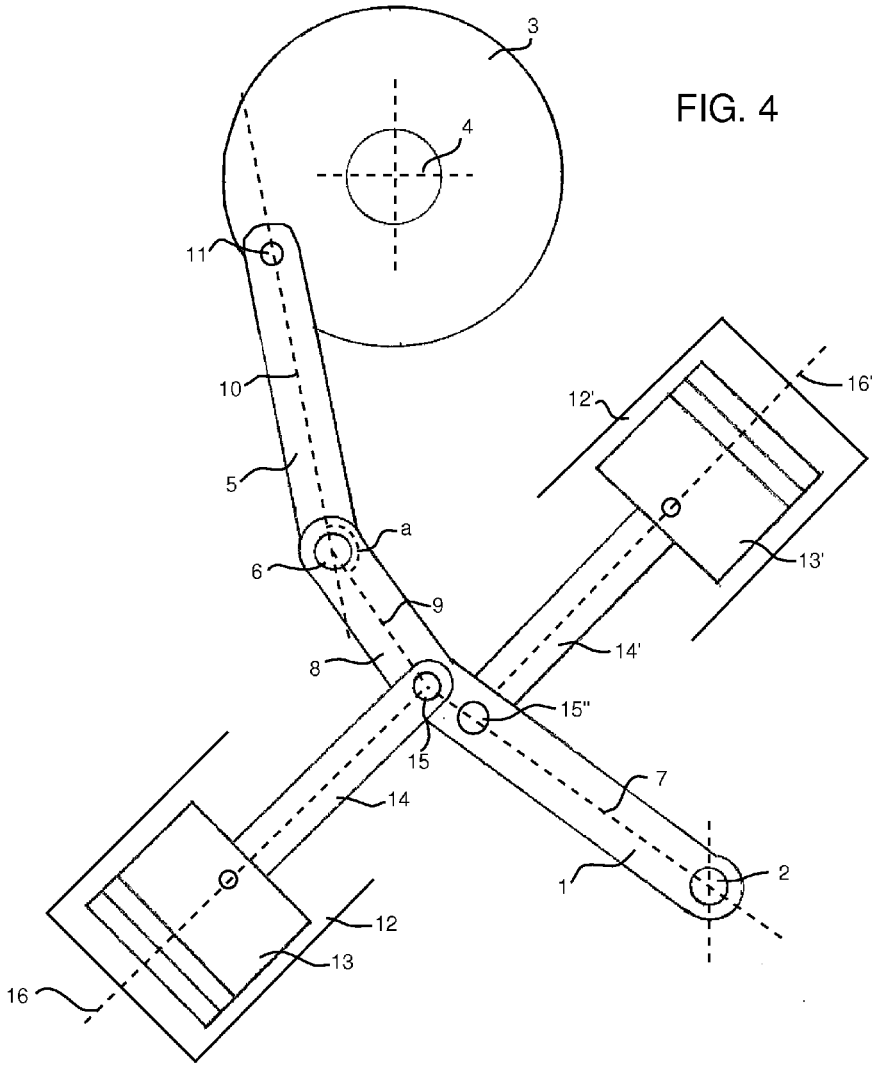
FIG. 4 shows an embodiment of the crank drive according to the invention, in which the crank is driven by means of two cylinders.

The crank drive sketched in FIG. 4 adds a second cylinder 12' arranged on an opposite side of the rocker 1 from the first cylinder 12, which can be filled with pressure medium and the a piston 13' of which is attached in an articulated manner, by means of a connecting rod 14', to the rocker 1, is provided as a drive input of the rocker 1. A joint 15" between the connecting rod 14' and the rocker 1 lies offset relative to joint 15 along the longitudinal axis of the rocker 1. The stroke of the second piston 13' of the second cylinder 12' is situated closer to the swing pivot 2 of the rocker 1 and is smaller than the stroke of the first piston 13 of the first cylinder 12. When the piston 13 is fully retracted, the stroke axis 16 of the cylinder 12 is aligned obliquely to a plane perpendicular to the rocker 1.

The toggle lever effect greatly intensifies the force introduced in the region where the angle a is straightened out. The resultant force exerted on the crank 3 is calculated in accordance with the formula $F=G/(2*\cos a/2)$, where G is the force acting on the rocker via the piston and F is the resultant. The torque applied to the crank 3 by way of the resultant F is therefore all the greater, the more the angle a is straightened out.

The invention claimed is:

1. A crank drive, comprising:

a frame;

a rocker pivotally mounted at a fixed position on said frame and having a free end opposite said fixed position;

a crank mounted in a fixed position on said frame and forming a drive output of the crank drive;

a coupler connecting said rocker and said crank, wherein said coupler is articulated at said crank and at said free end of said rocker;

said rocker including a remote segment distally from said fixed position at which said rocker is mounted to said frame, said remote segment being inclined by a fixed angle toward said coupler;

said rocker forming a toggle-joint-type mechanism with said coupler;

a cylinder for driving said crank, said cylinder including a movably mounted piston; and a connecting rod connecting said rocker to said piston by way of articulated connections, wherein an axial movement of said piston causes said rocker to assume an oscillating swinging motion.

2. The crank drive according to claim 1, wherein said frame is formed by a housing.

3. The crank drive according to claim 1, wherein said rocker and said remote segment form an integral element.

4. The crank drive according to claim 3, wherein said connecting rod is articulated at a point where said rocker bends into said remote segment.

5. The crank drive according to claim 1, wherein a stroke axis of said cylinder is aligned at an angle oblique to a plane perpendicular to said rocker.

6. The crank drive according to claim 1, wherein said cylinder is a first cylinder and said rocker is connected in an articulated manner to a second piston contained in a second cylinder, and wherein said second cylinder is arranged on an opposite side of said rocker from said first cylinder.

7. The crank drive according to claim 6, wherein said connecting rods are each attached in an articulated manner to an extension of said rocker, said extension being arranged transversely to said rocker.

8. The crank drive according to claim 7, wherein said lateral extension of said rocker is arranged on said segment of said rocker that is inclined toward said coupler.

9. The crank drive according to claim 6, wherein said first cylinder and said second cylinder are disposed with an offset relative to one another along a longitudinal axis of said rocker, and wherein a stroke of said piston of said first cylinder is greater than a stroke of said piston of said second cylinder.

10. The crank drive according to claim 9, wherein a stroke axis of said first cylinder is at an angle oblique to a stroke axis of said second cylinder.

11. The crank drive according to claim 1, wherein a dead center position of said crank is crossed at an upper point of reversal of the axial movement of said piston.

12. The crank drive according to claim 1, wherein said piston is a part of a combustion engine.

13. A crank drive, comprising:

a frame;

a rocker pivotally mounted at a fixed position on said frame and having a free end opposite said fixed position;

a crank mounted in a fixed position on said frame and forming a drive output of the crank drive;

a coupler connecting said rocker and said crank, wherein said coupler is articulated at said crank and at said free end of said rocker;

said rocker including a remote segment distally from said fixed position at which said rocker is mounted to said frame, said remote segment being inclined by a fixed angle toward said coupler;

a first cylinder for driving said crank, said first cylinder including a movably mounted first piston;

a connecting rod connecting said rocker to said first piston by way of articulated connections, wherein an axial movement of said first piston causes said rocker to assume an oscillating swinging motion; and said first cylinder and said rocker connected in an articulated manner to a second piston contained in a second cylinder, and said second cylinder is arranged on an opposite side of said rocker from said first cylinder with an offset relative to said first cylinder along a longitudinal axis of said rocker, and a stroke of said first piston of said first cylinder is greater than a stroke of said second piston of said second cylinder.

14. The crank drive according to claim 13, wherein a stroke axis of said first cylinder is at an angle oblique to a stroke axis of said second cylinder.

15. A crank drive, comprising:

a frame;

a rocker pivotally mounted at a fixed position on said frame and having a free end opposite said fixed position;

a crank mounted in a fixed position on said frame and forming a drive output of the crank drive;

a coupler connecting said rocker and said crank, wherein said coupler is articulated at said crank and at said free end of said rocker;

said rocker including a remote segment distally from said fixed position at which said rocker is mounted to said frame, said remote segment being inclined by a fixed angle toward said coupler;

said rocker forming a toggle-joint-type mechanism with said coupler;

a cylinder for driving said crank, said cylinder including a movably mounted piston moving along a stroke axis;

a connecting rod connecting said rocker to said piston by way of articulated connections, wherein an axial movement of said piston causes said rocker to assume an oscillating swinging motion; and wherein said stroke axis of said movably mounted piston is oblique to a longitudinal axis of said coupler, and said stroke axis does not intersect said crank.

* * * * *